US007427118B2

(12) United States Patent
Mizes et al.

(10) Patent No.: US 7,427,118 B2
(45) Date of Patent: Sep. 23, 2008

(54) SYSTEMS AND METHODS FOR DETECTING INTERMITTENT, WEAK AND MISSING JETS WITH AN INLINE LINEAR ARRAY SENSOR

(75) Inventors: Howard A. Mizes, Pittsford, NY (US); Kenneth R. Ossman, Macedon, NY (US); Stanley J. Wallace, Victor, NY (US); Michael D. Borton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 273 days.

(21) Appl. No.: 10/999,014

(22) Filed: Nov. 30, 2004

(65) Prior Publication Data

US 2006/0114284 A1 Jun. 1, 2006

(51) Int. Cl.
*B41J 29/38* (2006.01)

(52) U.S. Cl. ..... 347/19; 347/5; 347/14

(58) Field of Classification Search ..... 347/19, 347/12, 9, 5, 14
See application file for complete search history.

(56) References Cited

U.S. PATENT DOCUMENTS

| | | | | |
|---|---|---|---|---|
| 5,736,996 | A * | 4/1998 | Takada et al. | 347/19 |
| 6,637,853 | B1 * | 10/2003 | Ahne et al. | 347/19 |
| 6,789,870 | B2 * | 9/2004 | Barnes et al. | 347/19 |
| 6,832,824 | B1 * | 12/2004 | Baker et al. | 347/19 |
| 2005/0018006 | A1 * | 1/2005 | Im et al. | 347/19 |

* cited by examiner

*Primary Examiner*—Lam S Nguyen
(74) *Attorney, Agent, or Firm*—Oliff & Berridge, PLC

(57) ABSTRACT

Systems and methods are provided for detecting intermittent, weak or missing jets of a printer. The detection is implemented using a test pattern. Detected failed jets may be confirmed using a verification target. A printhead containing nozzles corresponding to detected failed jets may be wiped or purged.

34 Claims, 8 Drawing Sheets

SYSTEMS AND METHODS FOR DETECTING INTERMITTENT, WEAK AND MISSING JETS WITH AN INLINE LINEAR ARRAY SENSOR

BACKGROUND

Some printers, such as direct marking office printers, have a plurality of nozzles. Each nozzle fires drops of ink during passes of printing operations.

To produce printed image of good quality, the nozzles need to fire jets with adequate ink drop sizes, with adequate strength, and without omission.

SUMMARY

When a printhead nozzle fires drops of an insufficient drop size, then the print density will be less than the neighboring jets and a streak will occur in the image. When a printhead nozzle does not consistently fire drops, then the missing drops of ink will also lead to smaller print density in the pixel columns that jet writes and thus streaks. When a printhead nozzle loses its ability to fire drops of ink, then there will be no ink written in the pixel columns addressed by that jet and thus streaks. When intermittent, weak or missing jets occur, it is desirable that such intermittent, weak and missing (IWM) jets be detected, and subsequent correction be made.

Systems and methods are provided for detecting intermittent, weak and missing jets with an inline linear array sensor.

In various embodiments of systems and method, a method for detecting intermittent, weak or missing jets comprises obtaining a test pattern having a plurality of dashes produced by a row of nozzles; obtaining a response profile based on sensor responses in a cross section of the test pattern; obtaining a metric for the response profile; and obtaining a difference between the metric and a reference.

These and other features and details are described in, or are apparent from, the following detailed description.

BRIEF DESCRIPTION OF THE DRAWINGS

Various exemplary details of systems and methods are described, with reference to the following figures, wherein.

DETAILED DESCRIPTION OF EMBODIMENTS

Figure 1:
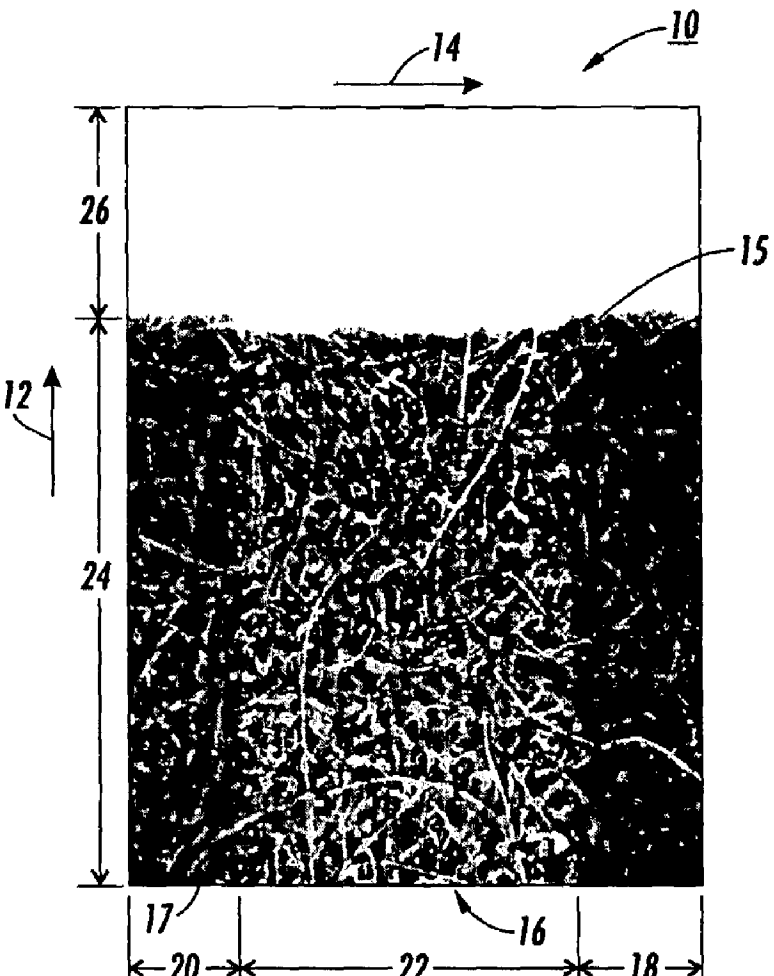
FIG. 1 illustrates an exemplary printing failure.

FIG. 1 shows an exemplary image 10. As shown in FIG. 1, the process direction 12 runs in the vertical direction. The top of FIG. 1 is the lead edge 15 of the image and the bottom of FIG. 1 is the trail edge 17 of the image. The printer nozzles (not shown) are arranged in a series of rows in the cross process direction 14 and fire drops of ink as the receiving medium passes in the process direction 12 under the nozzles.

As shown in FIG. 1, the image 10 is printed by the printer nozzles over a plurality of passes 16. In each pass 16, the nozzles print a section of the image 10 in the process direction 12. The width of the section may be one pixel.

During a pass 16, the printhead (not shown) moves in the cross process direction 14 for one pixel. Accordingly, on the next pass of the media under the printhead a different pixel column will be written to. This process continues as the printhead continuously moves in the cross process direction 14, and the image 10 is built by the sections produced in the passes 16.

As shown in FIG. 1, the image 10 is printed with failed jets. In particular, the left portion 20 and the right portion 18 of the image 10 are printed with normal nozzles, while the center portion 22 of the image 10 is printed with a nozzle having a failure.

The cause of the failure is that the nozzle produces drops of ink with a smaller mass than the rest of the nozzles on the printhead. Thus, as shown in FIG. 1, although the center portion 22 of the image 10 is printed uniformly, the ink coverage is not as dense, because of the smaller ink drops.

In addition, because the drops have a smaller mass, they travel more slowly from the printhead to the medium than the drops of regular size. Thus, it took longer for the failed drops to cross the gap between the printhead and the medium on which the image is printed. Consequently, the center portion 22 of the image 10 is translated in the process direction 12 relative to the left portion 20 and the right portion 18 of the image 10. In particular, as shown in FIG. 1, the center portion 22 of the image 10 is shifted down relative to the left portion 20 and right portion 18 of the image 10. As a result, as shown in FIG. 1, the lead edge 15 of the image is not a straight horizontal line, but is shifted down in the middle portion where the weak nozzle prints.

Figure 2:
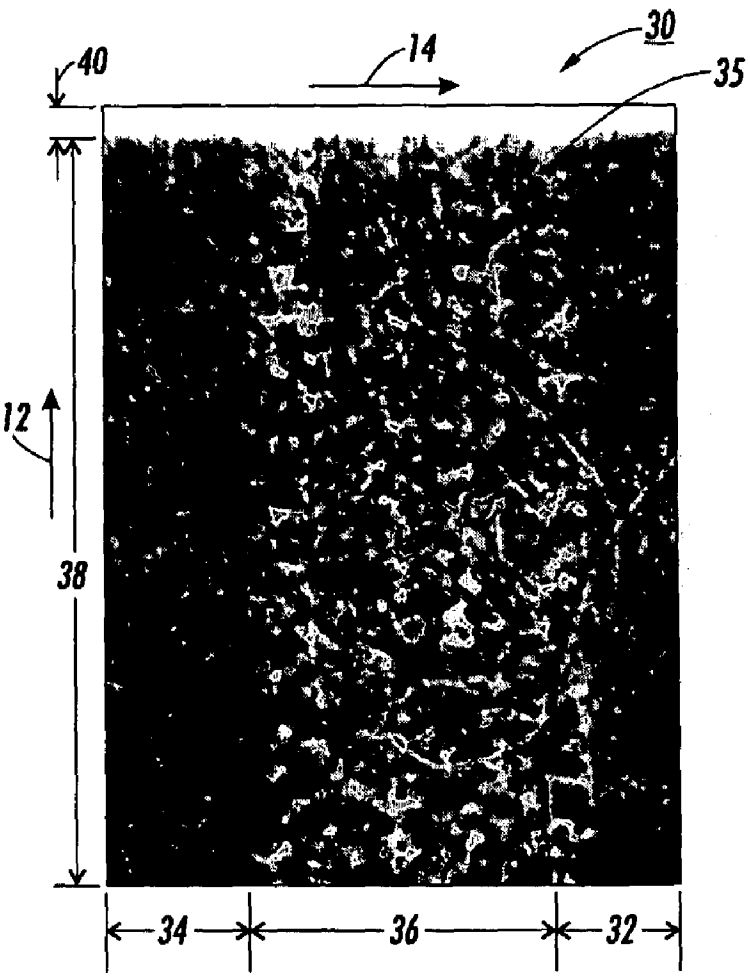
FIG. 2 illustrates another exemplary printing failure.

FIG. 2 illustrates another exemplary image 30 having failed jets. In FIG. 2, the left portion 34 and the right portion 32 of the image 30 are printed with normal nozzles, while the center portion 36 of the image 30 is produced by nozzles having intermittent jets. Accordingly, the center portion 36 of the image 30 is not fully covered by ink, with uncovered areas where the jets were not fired.

However, FIG. 2 does not indicate weak jets or jets with smaller drop mass. As shown in FIG. 2, the center portion 36 of the image 30 is not shifted or translated in the process direction 12. The lead edge 35 of the solid pattern is a straight line in the cross process direction.

The failed jets may be detected and identified. In various exemplary embodiments, the failed jets may be detected at different points during a customer print job. For example, the failed jets may be detected at the end of a job, at the end of a day, after a given number of prints, or on customer demand.

In various exemplary embodiments, the failure is detected using a test pattern. The dimensions of the test pattern may vary. The test pattern may be built up in multiple passes, depending on different requirements, such as the time available for detection, the techniques used in cleaning the test pattern, or a customer request. In various exemplary embodiments, a test pattern having only simple dashes produced during a single pass is used. In various exemplary embodiments, consideration is given whether the width of the linear array detector detector is greater than the process width, and whether all the nozzles can be printed and imaged by the linear array detector in a single pass.

Figure 3:
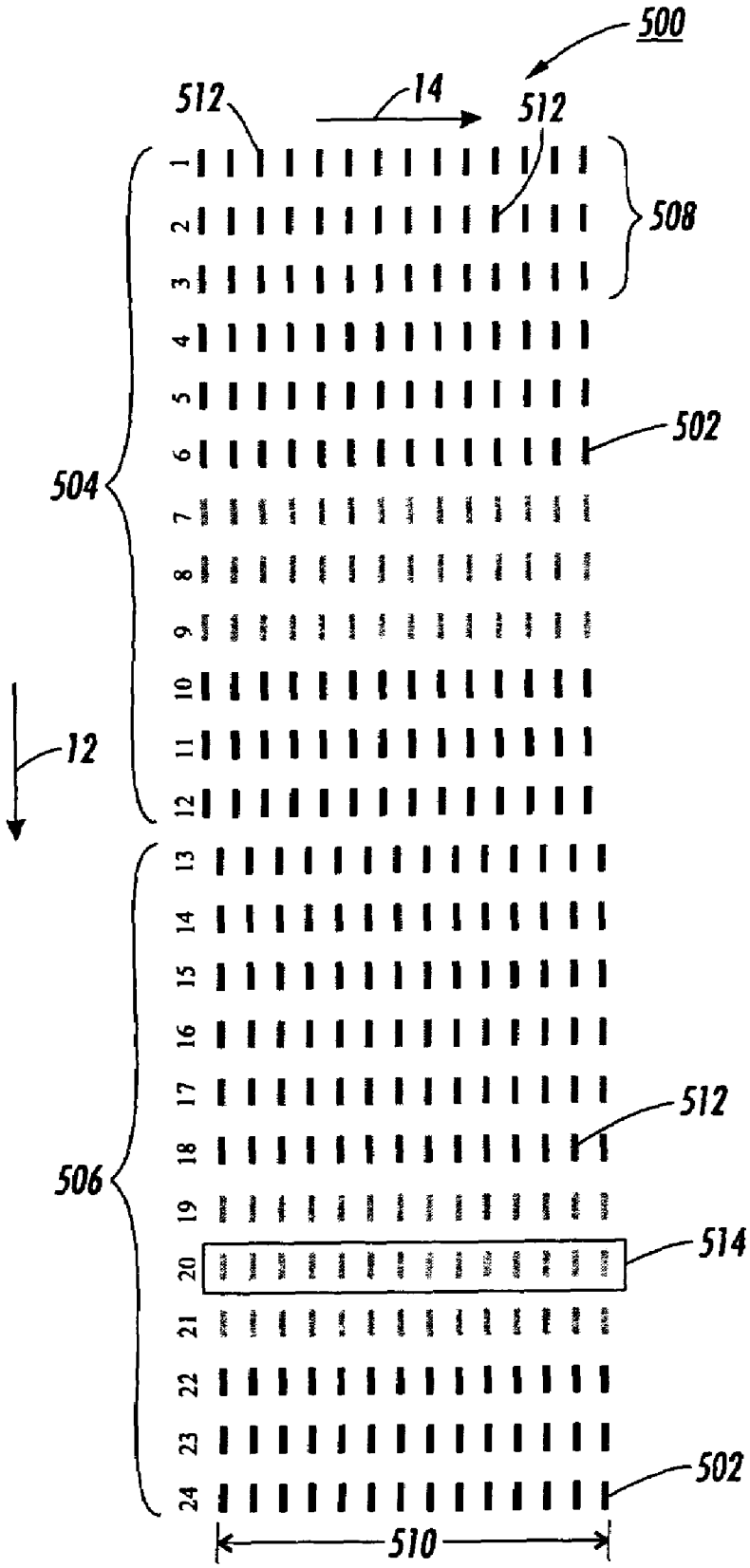
FIG. 3 illustrates an embodiment of a test pattern.

FIG. 3 illustrates an embodiment of a test pattern 500. In FIG. 3, the process direction 12 runs vertically from the top of the image to the bottom of the image. Only a section of the test pattern 500 in the cross process direction 14 (the horizontal direction) is shown in FIG. 3.

As shown in FIG. 3, the test pattern 500 includes an array of dashes 502. The dashes 502 are far enough apart in the cross process direction so they can be distinguished by the linear array sensor. The dashes 502 are long enough in the process direction 12 so that 2 or more scans of the linear array detector occur while the dash passes under the linear array detector.

As shown in FIG. 3, the dashes 502 each extend in the process direction 12. Each row of dashes is arranged in the cross process direction 14. The dashes 502 in a row are spaced or separated from each other with a substantially equal distance in the cross process direction 14. Each dash 502 is of substantially the same thickness and length.

In the test pattern 500 shown in FIG. 3, the nozzles of the printhead are spaced too closely to be distinguished if every nozzle prints dashes in a single row. Thus, as shown in FIG. 3, the odd nozzles print dashes in one row, and the even nozzles print dashes in another row. In particular, the dashes 504 printed by odd nozzles are in rows 1-12 (counting from the top), and the dashes 506 printed by the even nozzles are in rows 13-24.

In FIG. 3, for each printhead, dashes are printed by the cyan, magenta, yellow, and black nozzles. In particular, the dashes in rows 1-3 and 13-15 are printed by the cyan nozzles, the dashes in rows 4-6 and 16-18 are printed by the magenta nozzles, the dashes in rows 7-9 and 19-21 are printed by the yellow nozzles, and the dashes in rows 10-12 and 22-24 are printed by the black nozzles. For each color strip, the dash is repeated 3 times. For example, as shown in FIG. 3, a dash 508 from the odd cyan nozzles are printed 3 times, in rows 1, 2 and 3. The more the dash is repeated, the higher precision with which measurements can be made.

When the process width 510 (the dimension in the cross process direction) is greater than the ink on drum detector width, only a subset of the nozzles can be monitored each time. The printheads may be moved so that all nozzles to be monitored are within the field of view of the ink on drum detector. In various exemplary embodiments, a control scheme is set up that monitors a different subset of the nozzles during each measurement iteration. In various other exemplary embodiments, the printheads are repositioned during the course of a single measurement. In such other exemplary embodiments, all nozzles print dashes, but the dashes are printed on different sections of the drum in the process direction.

A test pattern may be produced at the nominal imaging speed as the normal printing mode for direct marking printers. In some cases, the velocity of the imaging media is such that an image taken with the linear array sensor will be compressed in the process direction compared to the cross process direction.

When the test pattern is imaged at full drum velocity for a high speed printer, the dashes will need to be very long so that they can still be resolved after the compression in the cross process direction. Such a length requirement may exceed the area available for imaging on the drum, or may increase the amount of ink that is required for making measurements.

In various embodiments, the drum is slowed down when imaging a test pattern. Such a slow-down reduces the required ink amount. However, the speed need not be very slow. The minimal speed is constrained by the ability to maintain a uniform drum rotation motion quality. The maximum speed is constrained by the maximum length of the dashes that can be accommodated and ink usage.

In various exemplary embodiments, the linear array inline sensor is operated in diffuse mode or in specular mode. In diffuse mode, the detectors are oriented normal to the surface being imaged, and the illuminators are at some angle. The contrast arises from the difference in geometry between the ink and the substrate. The contrast also arises due to a difference between the reflectance of the substrate and the reflectance of the ink. In specular mode, the contrast arises because of the difference in the amount of light scattered when imaging the substrate and when imaging ink on the substrate.

In various exemplary embodiments, linear array inline sensors having separate red, blue and green illuminators are used. In such exemplary embodiments, largest signals are obtained by using complementary color to image the ink, as shown in FIG. 4.

Figure 4:
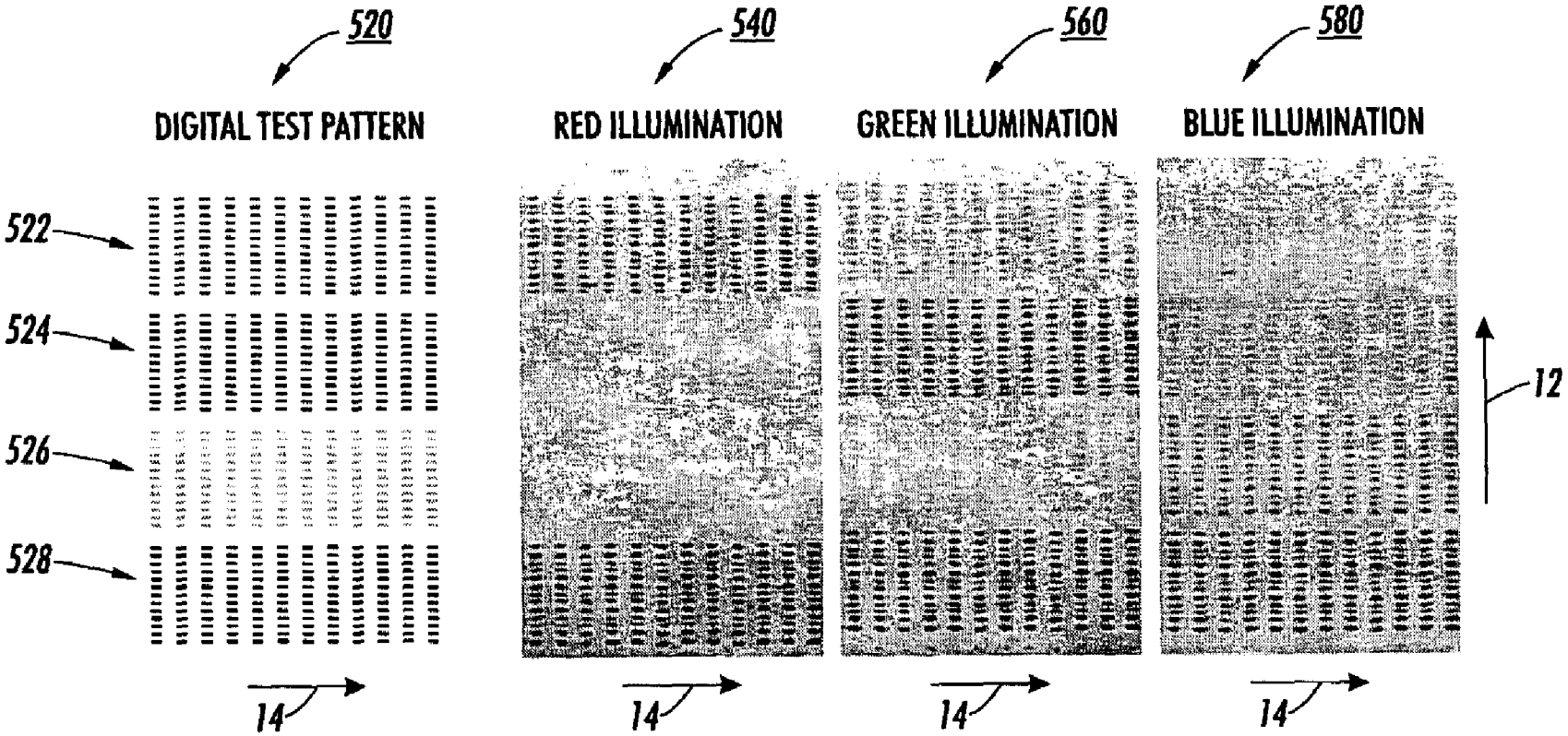
FIG. 4 illustrates an embodiment of a sensed image.

In FIG. 4, a digital test pattern 520, similar to the test pattern 500 shown in FIG. 3, is depicted on the left hand side. However, the dashes in FIG. 4 have a width that is larger than their length. On the right hand side of FIG. 4, red illumination 540, green illumination 560 and blue illumination 580 are depicted. The process direction 12 in FIG. 4 runs in the vertical direction. There are 12 repeats of each dash for each color of ink. Dash group 522 (the first 12 rows at the top of the test pattern) are written with cyan ink. Dash group 524 (the next 12 rows) are written with magenta ink. Dash group 526 (the following 12 rows) are written with yellow ink. Dash group 528 (the last 12 rows) are written with black ink.

As shown in FIG. 4, when the red illuminator 540 is used as a complementary color for cyan ink, there is a large contrast between the cyan ink and the drum substrate. Similarly, as shown in FIG. 4, the green illuminator 560 gives the largest contrast with magenta ink, and the blue illuminator 580 gives the largest contrast with yellow ink. For black ink, an illuminator of any color produces large contrast.

In various exemplary embodiments, each dash in the test pattern corresponds to one nozzle. The nozzle to which a dash corresponds to can be determined by counting the columns of dashes starting from one side of the image.

The presence of ink on the drum can either decrease or increase the response of sensors, depending on the relative contrast between the ink and the drum and the relative texture between the ink and the drum. For the ease of discussion, it is assumed that the presence of ink decreases sensor response. However, it should be appreciated that the discussion below also applies when the presence of ink increases sensor response.

In various exemplary embodiments, a projection of the imaged test pattern in the process direction 514 of sensor response is used to detect failed nozzles in a printed image. As shown in FIG. 3, the cross section 514 of the sensor response is a collection of profiles through the dashes 502 in the test pattern 500. A profile may include sensor response along the cross process direction 14 at a particular location in the process direction 12. In various exemplary embodiments, the cross section 514 is a collection of profiles through all the dashes 502 in a test pattern 500. In various exemplary embodiments, the cross section 514 is a collection of profiles through part of the dashes 502 in a test pattern 500.

In a response profile of the cross section 514 of sensor response, sensor response maxima occur at locations corresponding to positions where dashes do not exist, such as at the gaps 512 between dashes 502. On the other hand, sensor response minima occur in the response profile at positions corresponding to locations where dashes 502 are printed. The positions of the minima are used to obtain the locations of the corresponding dashes. In various exemplary embodiments, the positions of the minima are also used to obtain information of the nozzles which produced the dashes.

In various exemplary embodiments, the centers of the dashes may be determined based on the cross section of sensor response, using the minima in the response profile. The determination may be achieved by any existing or later developed techniques. In various exemplary embodiments, the center of a dash line is determined based on an interpolation of the response data near the dash minimum, a mid-point of the interpolated left and right dash edge position where a reflection threshold is exceeded, a non-linear least squares fit to some average functional form of the dash, or a multi-dimension vector under Radar theory.

In FIG. 3, the cross section 514 may extend in the process direction 12. Thus, a vertical strip of the image is sensed from the test pattern 500 in the vertical direction. As discussed above, because of the presence of the dashes 502, this cross section 514 provides a generally Gaussian response profile, having low response at positions corresponding to the centers of the dashes 502, and having high responses at locations corresponding to gaps 512 between the dashes. In various exemplary embodiments, the centers of the dashes are identified by identifying the minima in the response profile. In various exemplary embodiments, procedures are implemented for determining centers of the dashes even when the cross section is noisy due to noise from substrate structure and defective dashes.

Figure 5:
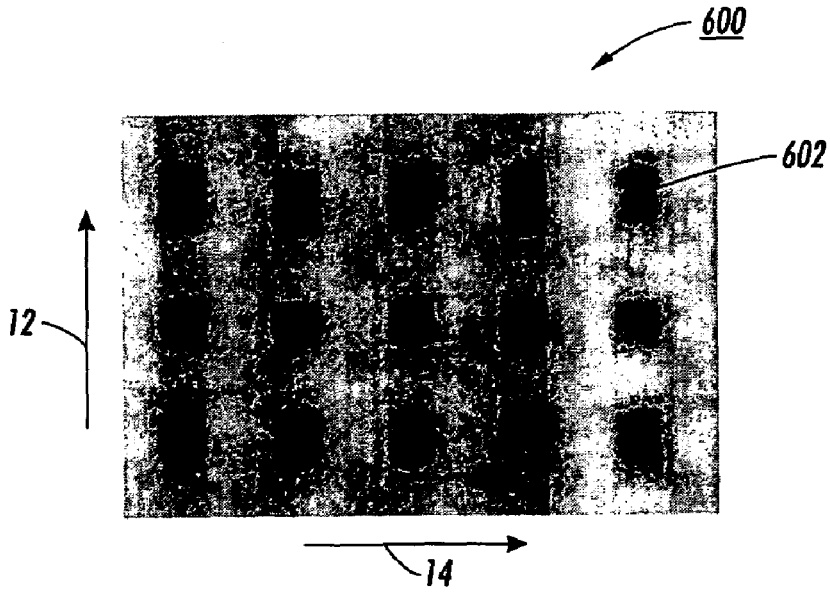
FIG. 5 illustrates another embodiment of a sensed image.

FIG. 5 illustrates an image 600 sensed from a test pattern, such as the test pattern 500 shown in FIG. 3. In FIG. 5, the process direction 12 is in the vertical direction. The dark dashes 602 correspond to dashes in the test pattern. The sensed image shown in FIG. 5 does not indicate significant failed jets.

Figure 6:
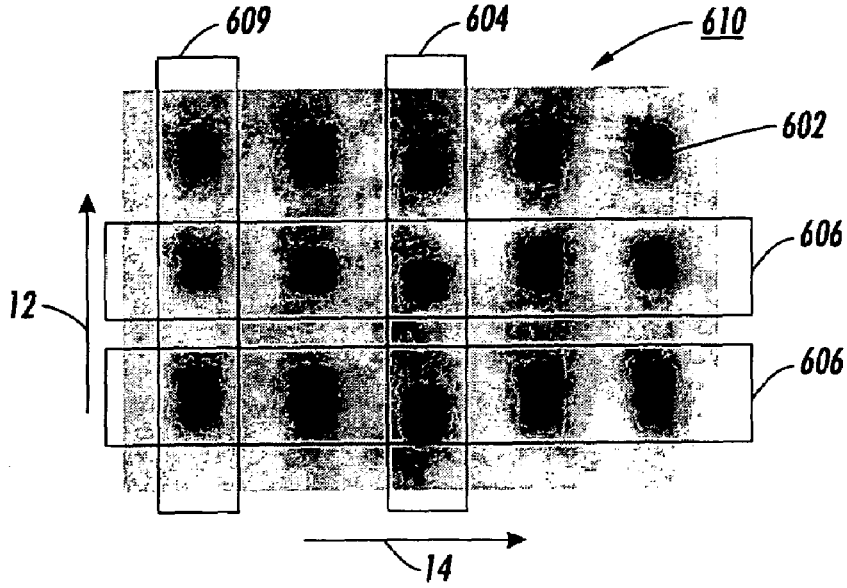
FIG. 6 illustrates still another embodiment of a sensed image.

FIG. 6 illustrates another sensed image 610 sensed from the same test pattern. Similar to FIG. 5, the dark dashes 602 correspond to dashes in the test pattern. As shown in FIG. 6, the dark dashes 602 of the middle column 604 of the sensed image 600 are shifted behind in the process direction 12. In particular, each dash 602 in the middle column 604 appear lower than the corresponding dashes in the neighboring columns. Such a shift indicates that the nozzle that produced this column of dashes had weak jets, producing drops of decreased ink mass. As discussed above, an ink drop with reduced size has less velocity, travels slower, takes longer to cross the gap between the nozzle and the print medium, arrives at a later time to the medium which is moving, and thus appears lower on the medium in the process direction 12, as shown in FIG. 6.

In FIG. 6, a cross section 606 of the sensed image 610 may be used to obtain a response profile. Different cross sections 606 may be applied along the cross process direction 14 at different positions along the process direction 12. As discussed above, the presence of the dashes 602 reduces response strength. Thus, each response profile is generally a Gaussian curve.

Figure 7:
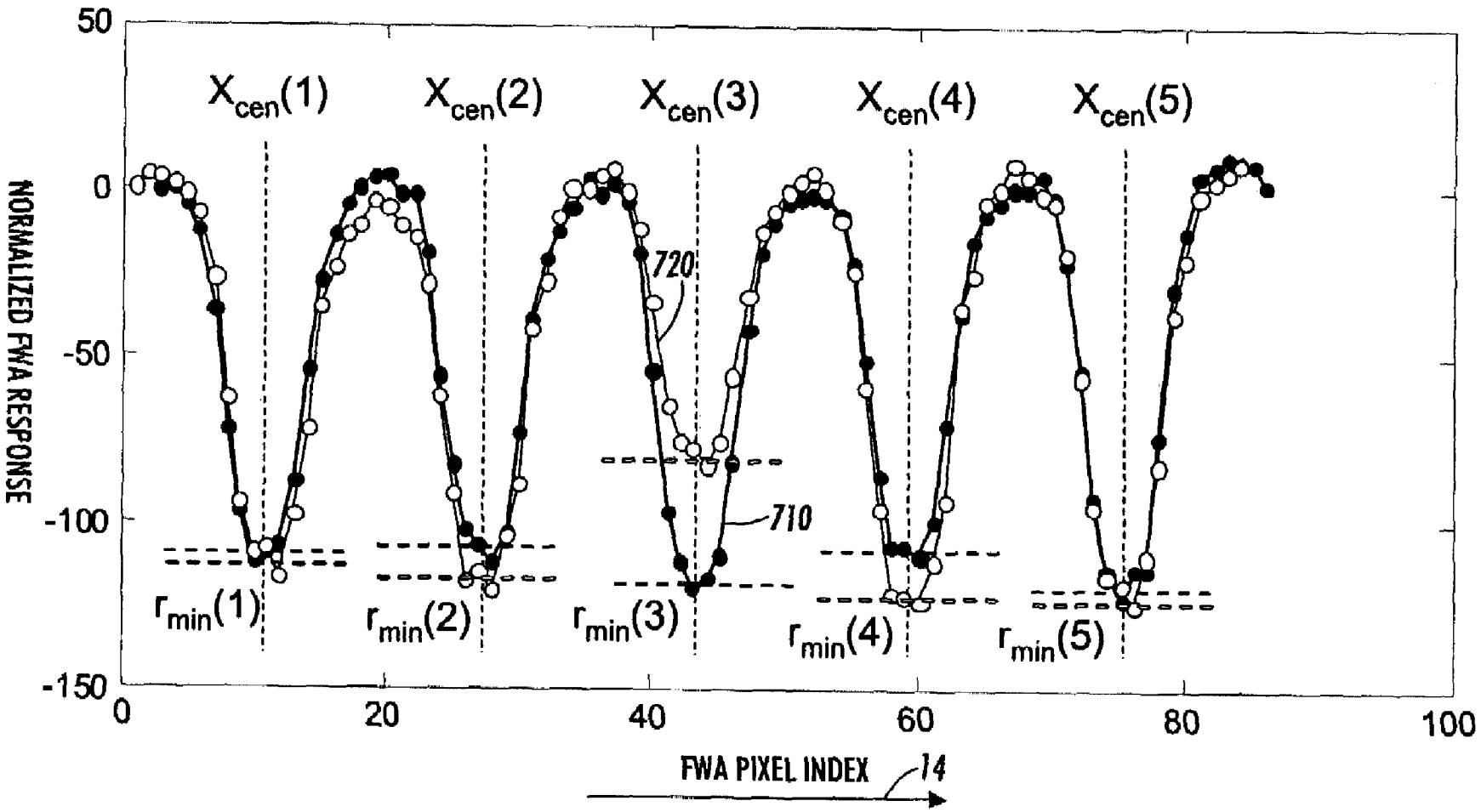
FIG. 7 illustrates embodiments of response profiles.

FIG. 7 illustrates a plurality of generally Gaussian response profiles. Each profile represents the response in a cross section 606 of the image 610 in FIG. 6 in the horizontal direction (cross process direction 14). Each cross section may be summed only with those linear array sensor scans that include a section of the test pattern dash. In various exemplary embodiments, various image processing steps are used to decrease the noise from background substrates.

In various exemplary embodiments, a plurality of metrics are extracted for each nozzle using the sensed image or sensed test pattern. The metrics may include the position of the drop in the cross process direction, such as the centers of the dashes in the cross process direction ($x_{cen}$); the position of the drop in the process direction, such as the centers of the dashes in the process direction ($y_{cen}$); and a metric related to the size of the drop, such as a minimal reflectance at the center of the drop ($r_{min}$).

FIG. 7 shows normalized response as a function of sensor pixel index in the cross process direction 14. The sensor pixel index provides a coordinate that generally corresponds to the cross process direction 14. As shown in FIG. 7, both the centers of the dashes in the cross process direction ($x_{cen}$) and the minimal reflectance at the center of the drop ($r_{min}$) can be determined. In particular, the position of a minimum in the Gaussian curve indicates the center of a dash. The magnitude of the response at the position of the minimum indicates the degree the drop attenuates the sensor response which in general is related to the drop size.

In FIG. 7, the solid line response profile 710 represents a cross section of the image in FIG. 5 where there is no failed jets. Thus, the solid line response profile 710 substantially conforms to a series of Gaussian curves with substantially the same amplitude. The five minimal reflectance $r_{min}(i)$, where i=1, 2, 3, 4 and 5, have substantially the same magnitude.

On the other hand, the dashed line response profile 720 represents a cross section of the image in FIG. 6, where the dashes in the middle column 604 are shifted down in the process direction 12 (see FIG. 6), due to failed jets of reduced ink drop size. Thus, because a dash that should have occupied a position in a test pattern may have been shifted out of the field of view of the linear array sensor, the reflectance from this position may be higher than expected. Accordingly, a cross section 606 that runs through a row of dashes in FIG. 6 may contain higher reflectance at a position near the middle column 604.

In particular, as shown in FIG. 7, the minimal response $r_{min}$ (3) corresponding to the dashes of the middle column 604 in FIG. 6 is significantly greater than the minimal reflectance $r_{min}$ (1), $r_{min}$ (2), $r_{min}$ (4) and $r_{min}$ (5) corresponding to the dashes in the neighboring columns in FIG. 6. Also, the minimal response $r_{min}$ (3) is significantly greater than the minimal reflectance $r_{min}$ (3) corresponding to the dashes in the middle column in FIG. 5. As discussed above, this is due to the shift of dashes in the middle column 604 of FIG. 6 in the process direction 12. Due to this shift, on average, the decrease of reflectance due to the presence of the dashes is reduced. Accordingly, the sensed reflectance is elevated. In various exemplary embodiments, this response elevation is used to detect weak jets with reduced ink drop size. Accordingly, the nozzle that produces the elevated response is flagged as a potential failed nozzle.

Referring back to FIG. 6, a cross section may also run along the process direction 12. In particular, as shown in FIG. 6, the cross section 609 runs through the dashes 602 along the process direction 12. The response profiles obtained from different cross sections 609 may be used to determine the position of the drop in the process direction, such as the centers of the dashes in the process direction ($y_{cen}$).

Figure 8:
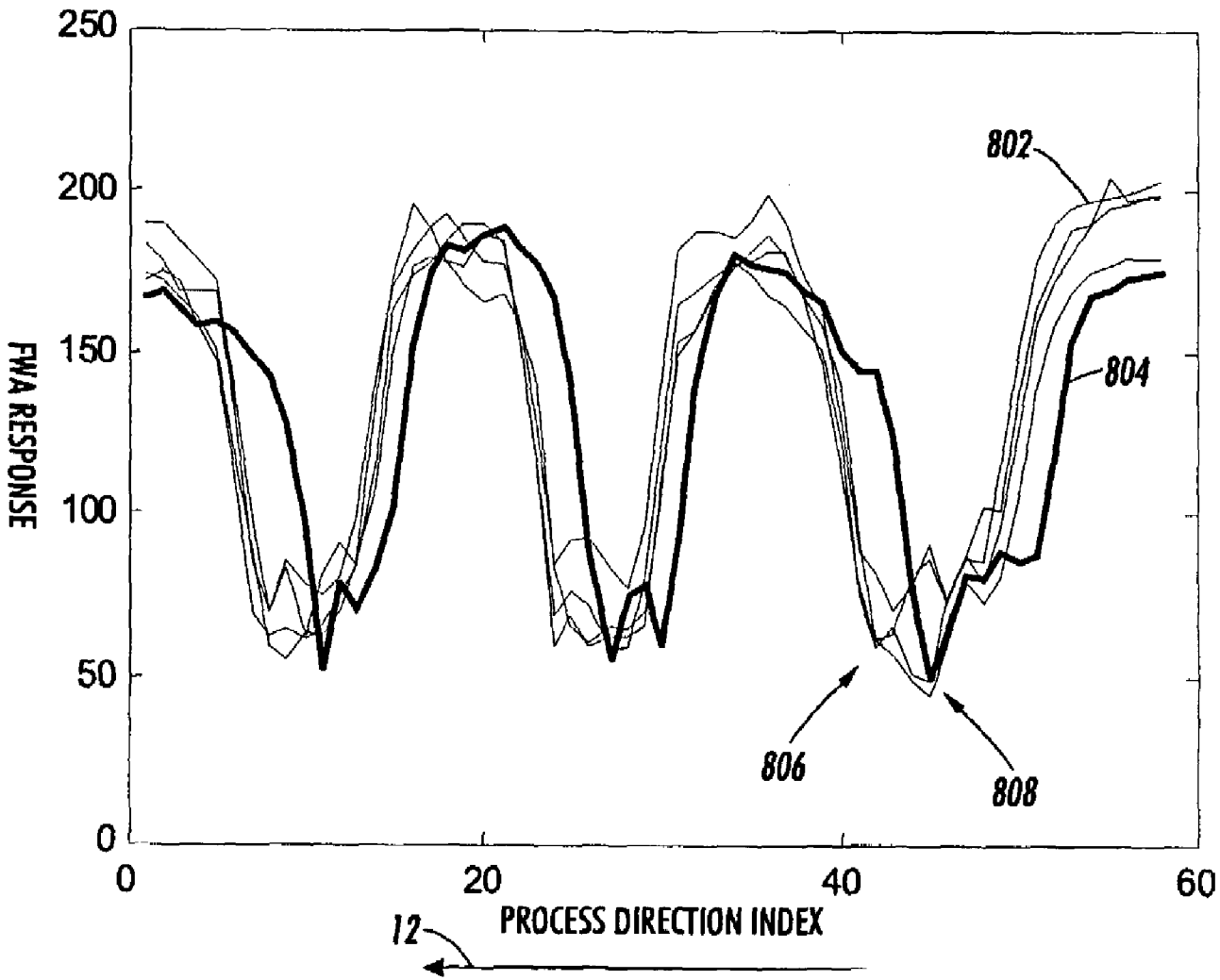
FIG. 8 illustrates embodiments of response profiles.

FIG. 8 illustrates a plurality of curves each representing a response profile of a cross section through the dashes 602 in FIG. 6 in the process direction 12. In FIG. 8, the response is shown as a function of the linear array sensor scan index in the process direction 12. The linear array sensor scan index is proportional to a position along the drum in the process direction 12.

In FIG. 8, the thin lines 802 correspond to dashes printed with nozzles having no failed jets. The thick line 804 corresponds to the dashes that are produced with failed jets and are shifted behind in the process direction 12. In various exemplary embodiments, the difference between the thick line and the thin line is used to detect failed jets. In particular, the difference between the positions 806 of the minimal reflectance of the thin lines 802 and the positions 808 of the minimal reflectance of the thick line 804 is used to determine the centers of the dashes in the process direction ($y_{cen}$).

In various exemplary embodiments, a number of signal processing techniques are used to extract the amount of the shift in the process direction 12 from the response profiles shown in FIG. 8. In various exemplary embodiments, the phase of the periodic response profiles is determined as a metric to detecting failed jets. The phase is proportional to the distance the dashes have been shifted in the process direction. In various exemplary embodiments, this phase is used to determine the position of the drop in the process direction ($y_{cen}$).

In various exemplary embodiments, a number of signal processing techniques are used to extract the amplitude of the response profiles shown in FIG. 8. The amplitude of the response profiles comprises an alternative metrics to the minimum reflectance. For a normally functioning jet with a low minimum reflectance, the amplitude of the response profile will be large. For a poorly functioning jet with a higher minimum reflectance, the amplitude of the response profile will be small. Similarly, in various exemplary embodiments, a number of signal processing techniques are used to extract the amplitude of the response profiles shown in FIG. 7.

In various exemplary embodiments, a threshold is established as a criteria for flagging a failed jet. The threshold allows for certain noise level in determining the process direction position of each jet, but is large enough to ensure that noise in the measurement of the process direction position is below this threshold. In various exemplary embodiments, the cutoff is chosen between two to three times the standard deviation of the noise in the measurement of a jets offset in the process direction.

In various exemplary embodiments, multiple criteria are established for identifying failed jets. For example, when either of the position of the drop in the cross process direction, the position of the drop in the process direction and the metric related to the size of the drop changes too much away from their expected values, a failed jet will be flagged.

In various exemplary embodiments, the position and magnitude of the drop is compared not to the mean position and magnitude of drops across the printhead, but instead to historical values of that drops position and magnitude before a potential failure. For example, even for a normal functioning printhead, there may still be some jet-to-jet variation in the position of the drop in the process direction. In various exemplary embodiments, a table may be built up of expected values for the position in the process direction, position in the cross process position, and drop magnitude for each nozzle. The table becomes more precise over time as more measurements are averaged together. Each subsequent measurement of position in the process direction, position in the cross process direction, and drop magnitude can be compared to the previously obtained values in the table. When a large variation from the expected value occurs, a failed jet is flagged.

The detected failed jets may be used for correction and adjustment. In various exemplary embodiment, the failed jets are detected when manufacturing the printheads. In various other exemplary embodiments, the failed jets are detected dynamically during printer operation.

In various exemplary embodiments, a flagged jet is verified in a verification step before the nozzle that produces the jet is purged. In various exemplary embodiments, the necessity of the verification step depends on the threshold chosen for flagging a jet as a failed jet. If the threshold is chosen too low and no verification step is used, then measurement noise on a normally operating nozzle may cause a purge. In various exemplary embodiments, a customers request is also taken into consideration when deciding whether a flagged jet needs to be verified before the associated nozzle is purged.

Figure 9:
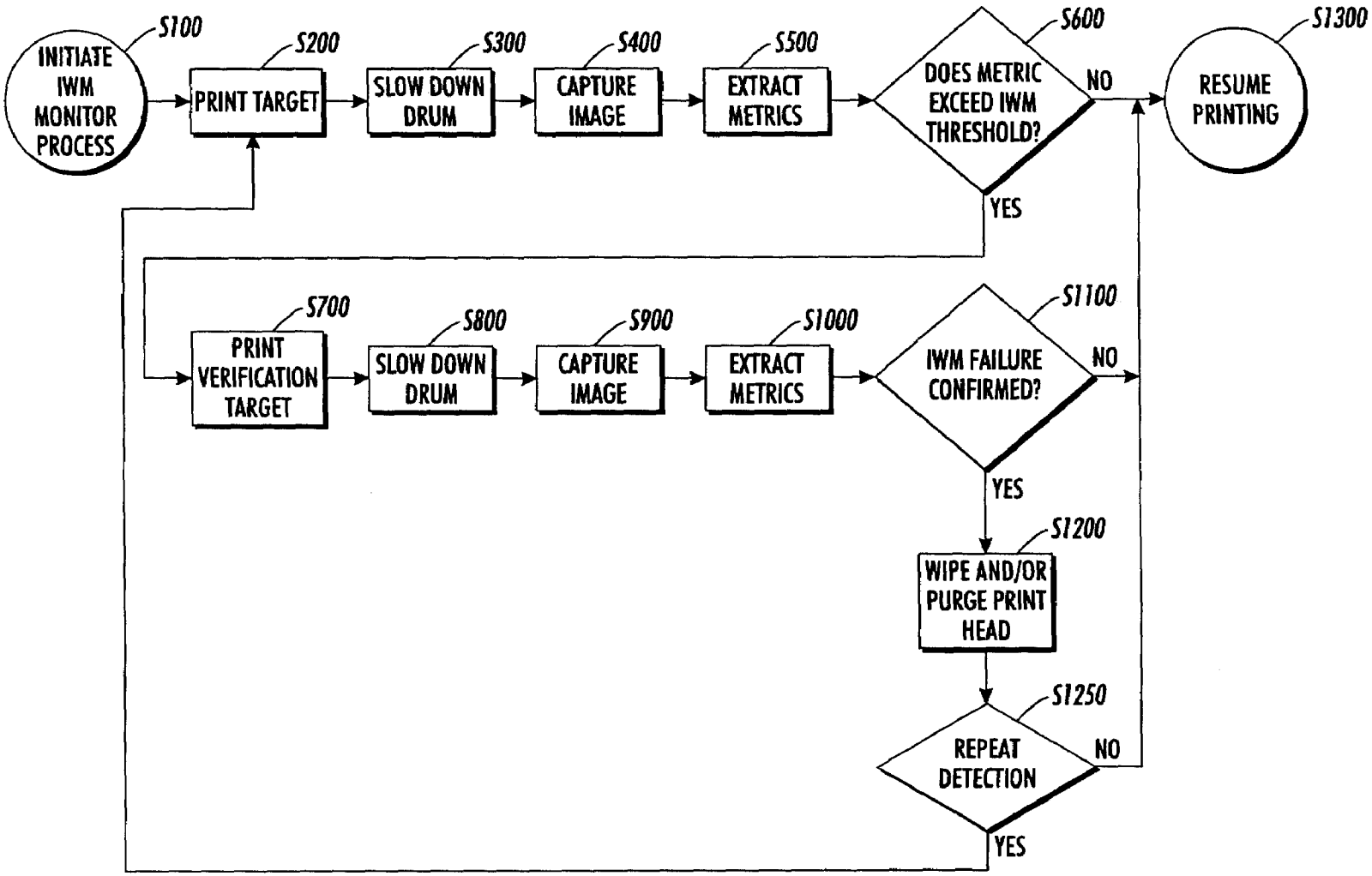
FIG. 9 is a flowchart outlining an embodiment of a method for detecting intermittent, weak or missing jets.

FIG. 9 is a flowchart outlining an embodiment of a method for detecting failed jets. As shown in FIG. 9, process of the method starts at step S100 by initiating an intermittent, weak or missing jet monitor process. The process can be initiated when the machine is turned on and/or cycles up, at the end of a job, after a given number of prints, or based on customer requests. Printing will resume after this monitor process is completed.

Next, in step S200, a test pattern or a target is printed. In various exemplary embodiments, the test pattern may be an array of dashes. Then, in step S300, the drum is slowed down. In various exemplary embodiments, the drum is slowed down to avoid having extremely long dashes in the test pattern which keeps the ink usage down to a minimum.

Next, in step S400, the image of the test pattern is captured by a sensor. In various exemplary embodiments, the sensor is a linear array sensor. Then, in step S500, the detected image is analyzed and metrics are extracted. The metrics include the cross process position, the process position, and the magnitude of a drop ejected from each nozzle in the field of view of the linear array sensor. Thereafter, process of the method continues to step S600.

In step S600, it is determined whether for any nozzle an extracted metric exceeds a threshold that indicates an intermittent, weak or missing jet. If it is determined at step S600 that no metric exceeds a threshold, process of the method jumps to step S1300, where the monitor process ends and printing may be resumed.

On the other hand, if it is determined in step S600 that a metric exceeds a threshold of an intermittent, weak or missing jet, process of the method continues to steps S700-S1100 for confirmation.

In particular, in step S700, a verification target or a confirmation pattern is printed. In various exemplary embodiments, the confirmation pattern is identical to the test pattern, but printed on a different area of the drum. Such a confirmation pattern printed on a different area of the drum improves the accuracy of the failed jet detection in the monitor process, because the effect of some isolated point defect on the drum may be prevented from giving any false positive signal. In various other exemplary embodiments, the confirmation pattern may be a part of the test pattern that includes the suspected failed jets and a few jets adjacent to the suspected failed jets. Such a reduced size of the confirmation pattern in relation to the test pattern prevents doubling the amount of ink required each time for confirming failed jets.

Next, in step S800, the drum is slowed down. Then, in S900, the image of the confirmation pattern is captured by the sensor. Afterwards, in step S1000, metrics are extracted from the captured confirmation pattern. Process of the method then continues to step S1100.

In step S1100, it is determined whether the failed jets (the intermittent, weak or missing jets detected in steps S200-S600) are confirmed. If the failed jets are not confirmed at step S1100, process of the method proceeds to step S1300, where operation of the method ends and printing is resumed.

On the other hand, if the failed jets are confirmed at step S1100, process of the method proceeds to step S1200, where the failed jets are wiped and/or purged. Operation then proceeds to step S1250.

In step S1250, a determination is made whether to perform more detection. If it is determined in step S1250 to perform more detection, operation of the method returns to step S200 to perform more detection, such as to detect whether the purge of the failed jets is effective, or to detect other failed jets. On the other hand, if it is determined in Step S1250 that more detection is unnecessary, operation of the method continues from step S1300, where operation of the method ends and printing is resumed.

In various exemplary embodiments, steps S700-S1100 in FIG. 9 may be omitted. In such exemplary embodiments, the printhead is wiped and/or purged once it is determined in S600 that a metric exceeds a threshold of an intermittent, weak or missing jet.

Figure 10:
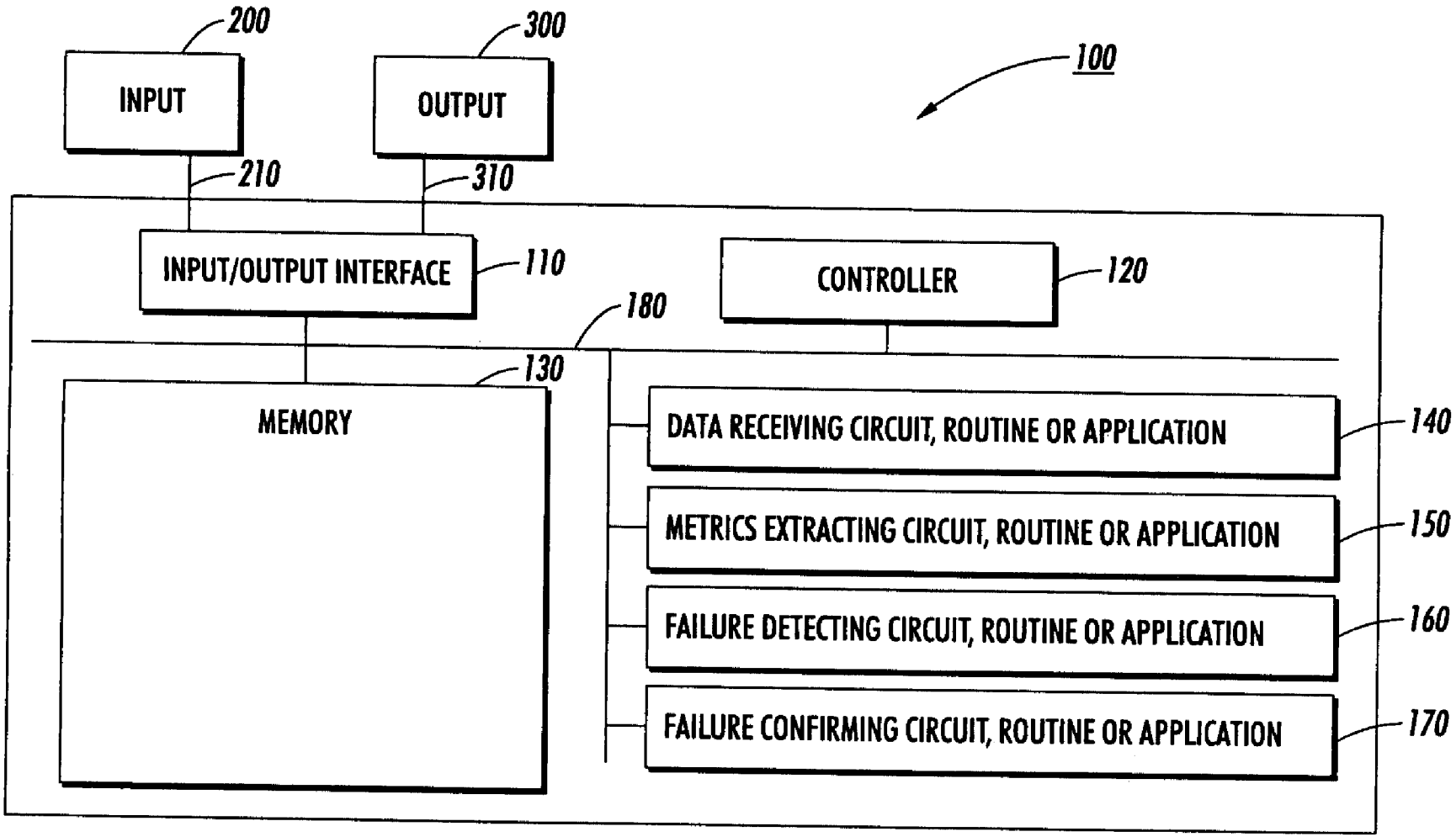
FIG. 10 is a functional block diagram of an embodiment of a system for detecting intermittent, weak or missing jets.

FIG. 10 is a functional block diagram of an embodiment of a system for detecting failed jets. As shown in FIG. 10, the system 100 may include an input/output (I/O) interface 110, a controller 120, a memory 130, a data receiving circuit, routine or application 140, a metrics extracting circuit, routine or application 150, a failure detecting circuit, routine or application 160, and a failure confirming circuit, routine or application 170, each interconnected by one or more control and/or data buses and/or application programming interfaces 180.

In various exemplary embodiments, the system 100 is implemented on a programmable general purpose computer. However, the system 100 can also be implemented on a special purpose computer, a programmed microprocessor or microcontroller and peripheral integrated circuit elements, an ASIC or other integrated circuits, a digital signal processor (DSP), a hard wired electronic or logic circuit, such as a discrete element circuit, a programmable logic device such as a PLD, PLA, FPGA or PAL, or the like. In general, any device capable of implementing a finite state machine that is in turn capable of implementing the flowchart shown in FIG. 9 can be used to implement the system 100.

The input/output interface 110 interacts with the outside of the system 100. In various exemplary embodiments, the input/output interface 110 may receive input from the outside, such as the input 200, via one or more links 210. The input/output interface 110 may output data to output 300 via one or more links 310.

The memory 130 may also store any data and/or program necessary for implementing the functions of the system 100. The memory 130 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and a disk drive, a writable or rewritable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or a DVD-ROM disk and disk drive or the like.

In the exemplary embodiment of the system 100 shown in FIG. 10, the data receiving circuit, routine or application 140, under control of the controller 120, receives data from the input 200 via the one or more links 210 and the input/output interface 110. The data may be signal detected by a sensor from printed test pattern or printed confirmation pattern.

The metrics extracting circuit, routine or application 150, under control of the controller 120, extracts metrics from the received data. The failure detecting circuit, routine or application 160, under control of the controller 120, determines whether a metric is greater than a threshold by comparing the difference between the metric with a reference. A failed jet is detected when the metric is greater than the threshold.

The failure confirming circuit, routine or application 170, under control of the controller 120, requests confirmation data, if a failed jet is determined by the failure detecting circuit, routine or application 160. Consequently, under control of the controller 120, the data receiving circuit, routine or application 140 receives confirmation data from a confirmation pattern. The metrics extracting circuit, routine or application 150 extracts metrics from the confirmation data. The failure detecting circuit, routine or application 160 detects failed jets from the metrics obtained from the confirmation pattern.

The failure confirming circuit, routine or application 170, under control of the controller 120, determines whether the failed jets are confirmed. The failure confirming circuit, routine or application 170, after failed jets are confirmed, sends signal to output 300 via input/output interface 110 and the one or more links 310 for wiping and/or purging the printhead containing the nozzles associated with the detected failed jets.

The controller 120 may also instructs the data receiving circuit, routine or application 140, the metrics extracting circuit, routine or application 150, and the failure detecting circuit, routine or application 160 to perform more detection after the purging.

The data receiving circuit, routine or application 140, the metrics extracting circuit, routine or application 150, the failure detecting circuit, routine or application 160, and the failure confirming circuit, routine or application 170 may receive data from, or send data to the memory 130. In particular, the threshold or thresholds may be stored in memory 130 and may be updated as needed.

The method illustrated in FIG. 9 may be implemented in a computer program product that can be executed on a computer. The computer program product may be a computer-readable recording medium on which a control program is recorded, or it may be a transmittable carrier wave in which the control program is embodied as a data signal.

While various details have been described, these details should be viewed as illustrative, and not limiting. Various modifications, substitutes, improvements or the like may be implemented within the spirit and scope of the foregoing disclosure.

What is claimed is:

1. A method for detecting intermittent, weak or missing jets of a printer having a row of nozzles, the method comprising:

printing a test pattern in its entirety, the test pattern having an array of dashes produced by the row of nozzles;

sensing the test pattern using a sensor;

obtaining a first response profile based on a first cross section of the sensed test pattern;

obtaining a first metric for the first response profile;

obtaining a difference between the first metric and a reference; and determining a nozzle that produces intermittent, weak or missing jets based on the difference by determining whether the difference is greater than a threshold, wherein if the difference is greater than the threshold, the method further comprising:

printing a confirmation pattern that is separate from the test pattern, the confirmation pattern being printed to be identical to a part of the printed and sensed test pattern; and confirming the intermittent, weak or missing jets over the confirmation pattern.

2. The method of claim 1, the first cross section of the sensed test pattern extending in a cross process direction of the test pattern, the first metric being a set of minimum illumination levels in the first response profile, and the reference being a set of reference illumination levels.

3. The method of claim 2, obtaining the first response profile comprising averaging in a process direction levels of illumination sensed from the test pattern.

4. The method of claim 1, the first cross section of the sensed test pattern extending in a cross process direction of the test pattern, the first metric being cross process direction positions of a set of minimum illumination levels in the first response profile, and the reference being a set of reference positions.

5. The method of claim 1, the first cross section of the sensed test pattern extending in a cross process direction of the test pattern, the first metric being a set of amplitudes of the first response profile, and the reference being a set of reference amplitudes.

6. The method of claim 5, obtaining the first response profile comprising averaging in a process direction levels of illumination sensed from the test pattern.

7. The method of claim 1, the first cross section extending in a process direction of the test pattern, the process direction being a direction in which a print medium advances, the first metric being a phase of a set of minimum illumination levels in the first response profile, and the reference being a reference phase.

8. The method of claim 7, obtaining a difference between the first metric and the reference comprising:

obtaining a second response profile based on a second cross section of the sensed test pattern, the second cross section extending in the process direction of the test pattern;

obtaining a second metric for the second response profile, the second metric being a phase of a set of minimum illumination levels in the second response profile; and obtaining a difference between the first metric and the second metric.

9. The method of claim 1, the first cross section of the sensed test pattern extending in a process direction of the test pattern, the process direction being a direction in which a print medium advances, the first metric being process direction positions of a set of minimum illumination levels in the first response profile, and the reference being a set of reference positions.

10. The method of claim 1, the first cross section extending in a process direction of the test pattern, the process direction being a direction in which a print medium advances, the first metric being a set of minimum illumination levels in the first response profile, and the reference being a set of reference illumination levels.

11. The method of claim 1, the first cross section of the sensed test pattern extending in a process direction of the test pattern, the process direction being a direction in which a print medium advances, the first metric being a set of amplitudes of the first response profile, and the reference being a set of reference amplitudes.

12. The method of claim 1, further comprising:

obtaining the reference from an average of previous measurements of the first metric.

13. The method of claim 1, the array of dashes including a plurality of substantially equally spaced rows of dashes and a plurality of substantially equally spaced columns of dashes, each row of dashes including dashes substantially equally spaced in a cross process direction produced by difference nozzles, each column of dashes including dashes substantially equally separated in a process direction produced by a same nozzle, the process direction perpendicular to the cross process direction, and each dash of the array of dashes extending a substantially same length in the process direction.

14. The method of claim 1, the method further comprising:

performing a nozzle cleaning operation on the printhead after confirming the intermittent, weak or missing jets.

15. The method of claim 14, the confirmation pattern containing dashes printed from suspected failed nozzles as well as dashes printed from functioning nozzles.

16. The method of claim 1, sensing the test pattern comprising:

slowing down a speed of a drum of the printer, the slowed speed slower than a normal operational speed with which the printer prints; and capturing an image of the test pattern at the slowed speed.

17. A computer-readable medium having computer-executable instructions for performing the method recited in claim 1.

18. A system for detecting intermittent, weak or missing jets of a printer having a row of nozzles, the system comprising:

a data receiving circuit, routine or application that senses a test pattern using a sensor, the test pattern being entirely printed and having an array of dashes produced by the row of nozzles and obtains a first response profile based on a first cross section of the sensed test pattern;

a metrics extracting circuit, routine or application that obtains a first metric for the first response profile;

a failure detecting circuit, routine or application that obtains a difference between the first metric and a reference, wherein the failure detecting circuit, routine or application further determines a nozzle that produces intermittent, weak or missing jets based on whether the difference is greater than a threshold; and a failure confirming circuit, routine or application that, when the difference is greater than the threshold, confirms the intermittent, weak or missing jets over a confirmation pattern that is separate from the test pattern, the confirmation pattern being printed to be identical to a part of the printed and sensed test pattern.

19. The system of claim 18, the first cross section of the sensed test pattern extending in a cross process direction of the test pattern, the first metric being a set of minimum illumination levels in the first response profile, and the reference being a set of reference illumination levels.

20. The system of claim 19, the data receiving circuit, routine or application obtains the first response profile by averaging in a process direction levels of illumination sensed from the test pattern.

21. The system of claim 18, the first cross section of the sensed test pattern extending in a cross process direction of the test pattern, the first metric being cross process direction positions of a set of minimum illumination levels in the first response profile, and the reference being a set of reference positions.

22. The system of claim 18, the first cross section of the sensed test pattern extending in a cross process direction of the test pattern, the first metric being a set of amplitudes of the first response profile, and the reference being a set of reference amplitudes.

23. The system of claim 22, wherein the data receiving circuit, routine or application obtains the first response profile by averaging in a process direction levels of illumination sensed from the test pattern.

24. The system of claim 18, the first cross section extending in a process direction of the test pattern, the process direction being a direction in which a print medium advances;

the first metric being a phase of a set of minimum illumination levels in the first response profile, and the reference being a reference phase.

25. The system of claim 24, wherein the failure detecting circuit, routine or application obtains a second response profile based on a second cross section of the sensed test pattern, the second cross section extending in the process direction of the test pattern;

obtains a second metric for the second response profile, the second metric being a phase of a set of minimum illumination levels in the second response profile; and obtains a difference between the first metric and the second metric.

26. The system of claim 18, the first cross section of the sensed test pattern extending in a process direction of the test pattern, the process direction being a direction in which a print medium advances, the first metric being process direction positions of a set of minimum illumination levels in the first response profile, and the reference being a set of reference positions.

27. The system of claim 18, the first cross section extending in a process direction of the test pattern, the process direction being a direction in which a print medium advances, the first metric being a set of minimum illumination levels in the first response profile, and the reference being a set of reference illumination levels.

28. The system of claim 18, the first cross section of the sensed test pattern extending in a process direction of the test pattern, the process direction being a direction in which a print medium advances, the first metric being a set of amplitudes of the first response profile, and the reference being a set of reference amplitudes.

29. The system of claim 18, wherein the metrics extracting circuit, routine or application obtains the reference from an average of previous measurements of the first metric.

30. The system of claim 18, the array of dashes including a plurality of substantially equally spaced rows of dashes and a plurality of substantially equally spaced columns of dashes, each row of dashes including dashes substantially equally spaced in a cross process direction produced by difference nozzles, each column of dashes including dashes substantially equally separated in a process direction produced by a same nozzle, the process direction perpendicular to the cross process direction, and each dash of the array of dashes extending a substantially same length in the process direction.

31. The system of claim 18, wherein the failure confirming circuit, routine or application performs a nozzle cleaning operation on the printhead after confirming the intermittent, weak or missing jets.

32. The system of claim 31, the confirmation pattern containing dashes printed from suspected failed nozzles as well as dashes printed from functioning nozzles.

33. The system of claim 18, wherein the data receiving circuit, routine or application slows down a speed of a drum of the printer, the slowed speed slower than a normal operational speed with which the printer prints; and captures an image of the test pattern at the slowed speed.

34. A marking device including the system of claim 18.

* * * * *